US006780054B2

(12) United States Patent
Yip et al.

(10) Patent No.: US 6,780,054 B2
(45) Date of Patent: Aug. 24, 2004

(54) SHIELDED OUTLET HAVING CONTACT TAILS SHIELD

(75) Inventors: Maxwell Yip, Trumbull, CT (US); Olindo Savi, Berlin, CT (US); Denny Lo, Danbury, CT (US)

(73) Assignee: The Siemon Company, Watertown, CT (US)

( * ) Notice: Subject to any disclaimer, the term of this patent is extended or adjusted under 35 U.S.C. 154(b) by 101 days.

(21) Appl. No.: 10/059,633

(22) Filed: Jan. 29, 2002

(65) Prior Publication Data

US 2002/0115346 A1 Aug. 22, 2002

Related U.S. Application Data

(63) Continuation-in-part of application No. 09/354,986, filed on Jul. 16, 1999, now Pat. No. 6,358,091, which is a continuation-in-part of application No. 09/235,851, filed on Jan. 22, 1999, now abandoned, which is a continuation-in-part of application No. 09/047,046, filed on Mar. 24, 1998, now Pat. No. 6,224,423, which is a continuation-in-part of application No. 09/007,313, filed on Jan. 15, 1998, now Pat. No. 6,328,601.

(60) Provisional application No. 60/264,770, filed on Jan. 29, 2001.

(51) Int. Cl.[7] ..... H01R 13/648

(52) U.S. Cl. ..... 439/607; 439/101; 439/610

(58) Field of Search ..... 439/101, 109, 439/607–610, 676–677, 417, 469, 108

(56) References Cited

U.S. PATENT DOCUMENTS

| | | | |
|---|---|---|---|
| 4,337,989 | A | 7/1982 | Asick et al. |
| 4,659,163 | A | 4/1987 | Althouse et al. |
| 4,682,836 | A | 7/1987 | Noorily et al. |
| 4,891,022 | A | 1/1990 | Chandler et al. |
| 4,990,094 | A | 2/1991 | Chandler et al. |
| 5,160,273 | A | 11/1992 | Carney |
| 5,310,354 | A | 5/1994 | Oswald, Jr. |
| 5,372,513 | A | 12/1994 | Rodrigues et al. |
| 5,376,021 | A | 12/1994 | Rodrigues et al. |
| 5,429,520 | A | 7/1995 | Morilion et al. |
| 5,433,618 | A | 7/1995 | Morilion et al. |
| 5,443,392 | A | 8/1995 | Longueville et al. |
| 5,509,824 | A | 4/1996 | Rodrigues et al. |
| 5,518,421 | A | 5/1996 | Davis |
| 5,538,440 | A | 7/1996 | Rodrigues et al. |
| 5,564,940 | A | 10/1996 | Rodriques et al. |
| 5,564,949 | A | 10/1996 | Wellinsky |
| 5,593,311 | A | 1/1997 | Lybrand |
| 5,605,469 | A | 2/1997 | Wellinsky et al. |
| 5,634,817 | A | 6/1997 | Siemon et al. |
| 5,637,015 | A | 6/1997 | Tan et al. |
| 5,660,551 | A | 8/1997 | Sakurai at al. |

(List continued on next page.)

FOREIGN PATENT DOCUMENTS

| | | |
|---|---|---|
| EP | 0 268 441 A2 | 5/1988 |
| EP | 0 517 180 A1 | 12/1992 |

(List continued on next page.)

*Primary Examiner*—Lincoln Donovan
(74) *Attorney, Agent, or Firm*—Cantor Colburn LLP

(57) ABSTRACT

An embodiment is a telecommunication outlet mounted on a printed circuit board (PCB) including a vertical shield extension and an inner shield extension which protrude downwards beyond the PCB. The vertical shield extension and the inner shield extension form a cross structure protruding downwards beyond the PCB, in which the cross structure defines four shielded quadrants each for housing contact tails of a tip and ring pair protruding downwards beyond the PCB. Shielding contact tails from each other with the extensions of the cross structure provides enhanced shielding and reduces crosstalk.

15 Claims, 4 Drawing Sheets

U.S. PATENT DOCUMENTS

| | | | | | |
|---|---|---|---|---|---|
| 5,681,180 | A | | 10/1997 | Rodrigues | |
| 5,755,595 | A | | 5/1998 | Davis et al. | |
| 5,876,248 | A | | 3/1999 | Brunker et al. | |
| 5,890,917 | A | | 4/1999 | Ishida et al. | |
| 5,895,292 | A | | 4/1999 | Affeltranger | |
| 5,924,890 | A | | 7/1999 | Morin et al. | |
| 5,934,940 | A | * | 8/1999 | Maranto et al. | 439/607 |
| 6,045,389 | A | | 4/2000 | Ferrill et al. | |
| 6,053,771 | A | * | 4/2000 | Hood et al. | 439/607 |
| 6,077,122 | A | | 6/2000 | Elkhatib et al. | |
| 6,595,801 | B1 | * | 7/2003 | Leonard et al. | 439/607 |

FOREIGN PATENT DOCUMENTS

| | | |
|---|---|---|
| EP | 0 755 100 A2 | 1/1997 |
| TW | 250597 | 7/1995 |
| WO | WO87/07441 | 12/1987 |
| WO | WO89/11169 | 11/1989 |
| WO | WO92/08261 | 5/1992 |
| WO | WO92/09119 | 5/1992 |
| WO | WO 98/48488 | 10/1998 |

* cited by examiner

SHIELDED OUTLET HAVING CONTACT TAILS SHIELD

CROSS-REFERENCE TO RELATED APPLICATIONS

This application claims the benefit of U.S. Provisional Application No. 60/264,770, filed Jan. 29, 2001 and this application is a continuation-in-part of U.S. patent application Ser. No. 09/354,986 filed Jul. 16, 1999, now U.S. Pat. No. 6,358,091, the entire contents of which are incorporated by reference herein, which is a continuation-in-part of U.S. patent application Ser. No. 09/235,851 filed Jan. 22, 1999, now abandoned, the entire contents of which are incorporated by reference herein, which is a continuation-in-part of U.S. patent application Ser. No. 09/047,046 filed Mar. 24, 1998, now U.S. Pat. No. 6,224,423, the entire contents of which are incorporated by reference herein, which is a continuation-in-part of U.S. patent application Ser. No. 09/007,313 filed Jan. 15, 1998, now U.S. Pat. No. 6,328,601, the entire contents of which are incorporated by reference herein.

BACKGROUND OF THE INVENTION

1. Field of the Invention

The invention relates generally to telecommunications connectors and in particular to a telecommunications outlet having shielding members extending along contact tails.

2. Prior Art

Improvements in telecommunications systems have resulted in the ability to transmit voice and/or data signals along transmission lines at increasingly higher frequencies. Several industry standards that specify multiple performance levels of twisted-pair cabling components have been established. The primary references, considered by many to be the international benchmarks for commercially based telecommunications components and installations, are standards ANSI/TIA/EIA-568-A (/568) Commercial Building Telecommunications Cabling Standard and 150/IEC 11801 (/11801), generic cabling for customer premises. For example, Category 3, 4 and 5 cable and connecting hardware are specified in both /568 and /11801, as well as other national and regional specifications. In these specifications, transmission requirements for Category 3 components are specified up to 16 MHZ. Transmission requirements for Category 4 components are specified up to 20 MHZ. Transmission requirements for Category 5 components are specified up to 100 New standards are being developed continuously and currently it is expected that future standards will require transmission requirements of at least 600 MHZ. To achieve such transmission rates, fully shielded twisted pair cable will be necessary in which each pair is individually wrapped in a foil or screen. In addition, all pairs are wrapped together in a layer of foil or screen.

The above referenced transmission requirements also specify limits on near-end crosstalk (NEXT). Telecommunications connectors are organized in sets of pairs, typically made up of a tip and ring connector. As telecommunications connectors are reduced in size, adjacent pairs are placed closer to each other creating crosstalk between adjacent pairs. To comply with the near-end crosstalk requirements, a variety of techniques are used in the art.

U.S. Pat. No. 5,593,311 discloses a shielded compact data connector designed to reduce crosstalk between contacts of the connector. Pairs of contacts are placed within metallic channels. When the connectors are mated, the channels abut against each other to enclose each pair in a metallic shield. One disadvantage to the design in U.S. Pat. No. 5,593,311 is that no shield is provided for contact tails extending beyond the bottom of a connector housing. As a result, the shielding effect is reduced and crosstalk occurs between the contact tails. Thus, there is a perceived need in the art for a connector having improved pair shielding.

SUMMARY OF THE INVENTION

The above-discussed and other drawbacks and deficiencies of the prior art are overcome or alleviated by the enhanced performance telecommunication outlet of the present invention. In one embodiment, a telecommunication outlet for mounting on a printed circuit board, comprises: a conductive housing having a top, a bottom, side walls joining the top and bottom, and a rear having an outer shield, an inner shield and a center shield joining the outer shield and the inner shield, the top, bottom, side walls and rear being in electrical contact; a vertical shield extending between the top and bottom; and a horizontal shield positioned between the top and bottom and between the sidewalls, the horizontal shield and the vertical shield defining four quadrants, each of the four quadrants containing contacts corresponding to a tip and ring pair; wherein the contacts each have a contact tail extending downwards beyond the printed circuit board, and the inner shield has an extension extending downwards beyond the printed circuit board, the extension being disposed between a first set and a second set of the contact tails. The printed circuit board includes metal plated holes for receiving the respective contact tails and a metal plated slot for receiving the extension of said inner shield. Preferably, the length of the protruding portion of the inner shield extension is substantially equal to the length of the protruding portion of the contact tails.

In a further embodiment of the present invention, the vertical shield of the telecommunication outlet further includes an extension extending downwards beyond the printed circuit board. When the contact tails are arranged in rows and columns, the inner shield extension is disposed between two rows of the contact tails and the vertical shield extension is disposed between two columns of the contact tails. In this embodiment, the printed circuit board further includes a metal plated slot for receiving the vertical shield extension. The vertical shield extension and the inner shield extension form a cross structure extending downwards beyond the printed circuit board, in which the cross structure defines four quadrants each for shielding the contact tails of a tip and ring pair.

BRIEF DESCRIPTION OF THE DRAWINGS

This disclosure will present in detail the following description of preferred embodiment with reference to the following figures wherein.

DETAILED DESCRIPTION OF THE INVENTION

Detailed illustrative embodiments of the present invention are disclosed herein. However, specific structural and functional details disclosed herein are merely representative for purposes of describing preferred embodiments of the present invention.

Figure 1:
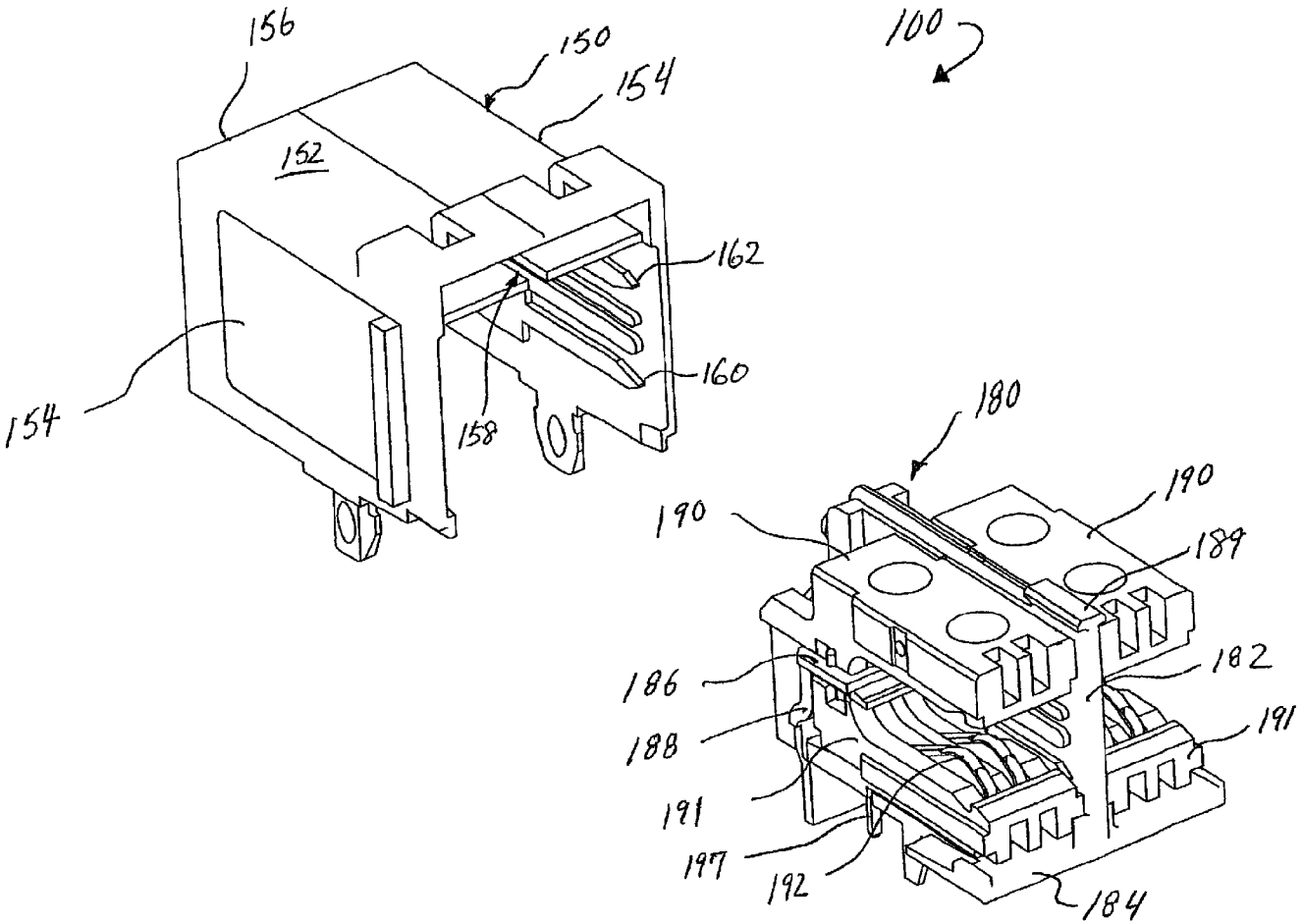
FIG. 1 is an exploded perspective view of a telecommunication outlet according to a preferred embodiment of the present invention.

FIG. 1 is an exploded perspective view of a telecommunications outlet 100 according to a preferred embodiment of the present invention. The outlet 100, preferably suitable for mounting onto a printed circuit board (PCB), includes a conductive cover 150 and a conductive core 180. The cover 150 and the core 180 may be conductive and have conductive components made from metal, metallized plastic or any other known conductive material. Preferably, the cover 150 and core 180 are metal, die-cast parts.

The cover 150 includes top 152, side walls 154 and rear wall 156. The side walls 154 are generally parallel to each other and the real wall 156 is generally perpendicular to the side walls 154. The core 180 includes a vertical shield 182, a bottom 184, a horizontal shield 186 and an inner shield 188. The vertical shield 182 is substantially perpendicular to the bottom 184 of the core 180. The horizontal shield 186 is disposed between and generally parallel to the top and bottom of the core 180. The inner shield 188 is generally perpendicular to the horizontal shield 186 and extends from the horizontal shield 186 towards the bottom 184. The vertical shield 182 includes a tap 189 on its top, and the top cover 152 includes a notch 158 for receiving the tap 189. The tap 189 engages the notch 158 to allow the core 180 slidably entered into and securely coupled with the cover 150.

The core 180 also includes contact carriers containing contacts for providing electrical connection with externally applied wires. For example, the core 180 includes top contact carriers 190 and bottom contact carriers 191. The top and bottom contact carriers 190, 191 each contain two contacts 192 that correspond to a tip and ring pair. The exemplary outlet shown in FIG. 1 is designed for four tip and ring pairs. In other words, the top contact assembly has two top contact carriers 190 each containing two top contacts of a tip and ring pair, and the bottom contact assembly has two bottom contact carriers 191 each containing two bottom contacts of a tip and ring pair. The contacts 192 change direction by approximately 90 degrees. In an alternate embodiment, the contacts do not change direction and the outlet opening is parallel to the PCB. A detailed description of the contacts in a telecommunications outlet is disclosed in commonly assigned U.S. Pat. No. 6,224,423 to Yip et al., the disclosure in its entirety is incorporated by reference herein.

Figure 2:
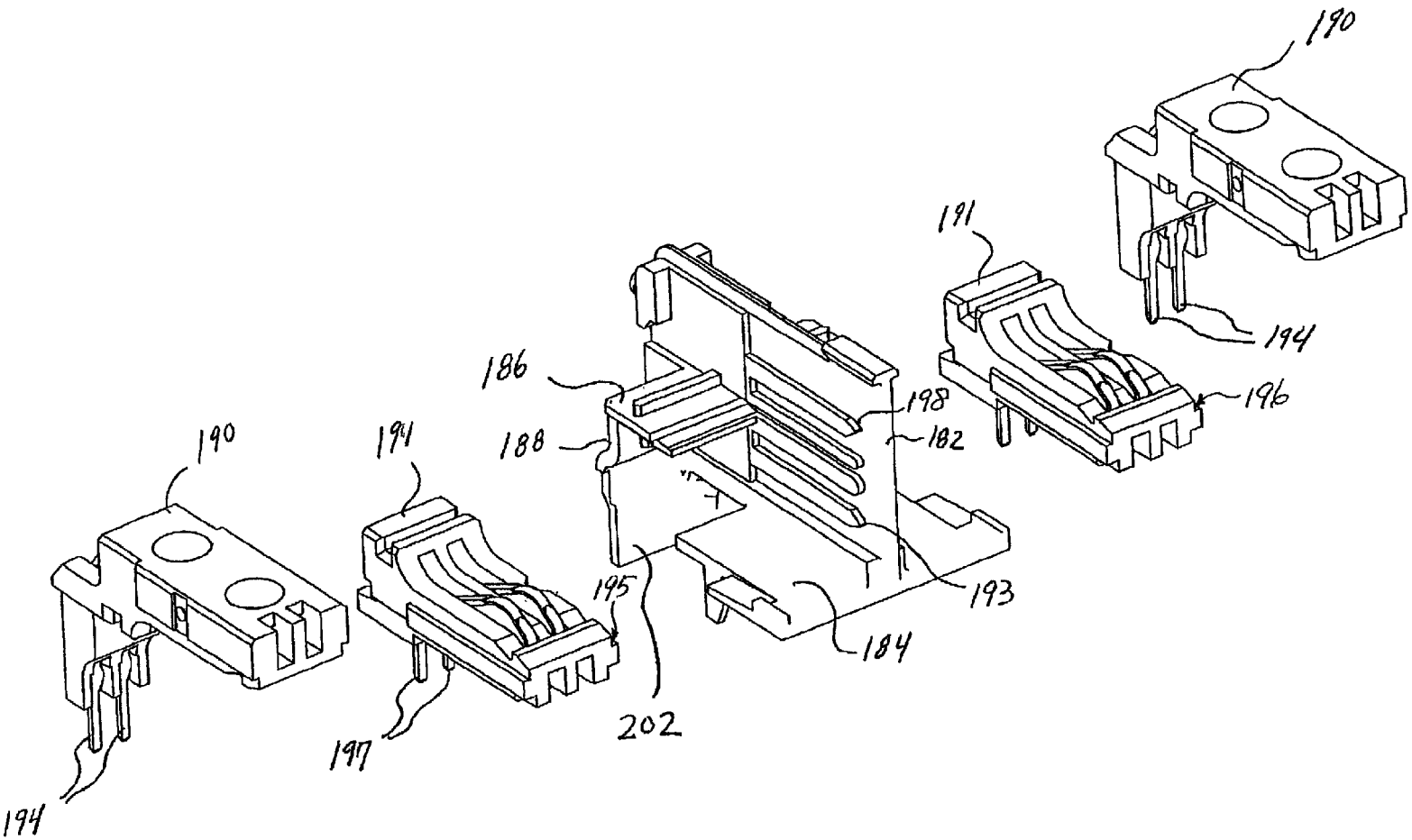
FIG. 2 is an exploded perspective view of an outlet core in FIG. 1.

FIG. 2 is an exploded perspective view of the core 180 in FIG. 1. Referring to FIGS. 1 and 2, the side walls 154 of the cover 150 and the vertical shield 182 of the core 180 have ribs for serving to secure the core 180 in the cover 150. The vertical shield 182 includes a first rib 193 formed on either side of the vertical shield 182. The first rib 193 has a lower edge that engages recess 195 on the bottom contact carrier 191 to secure the bottom contact assembly in the outlet core 180. Similarly, the side walls 154 each include a rib 160 that engages recess 196 on the bottom contact carrier 191. The vertical shield 182 and the side walls 154 also include second ribs 198, 162, respectively, for engaging corresponding recesses on the top contact carrier 190 to secure the top contact assembly within the core 180 and the cover 150. The contacts 192 each have a contact tail extending beyond the bottom 184 to engage a PCB (referring to FIGS. 4A and 4B). The top contacts contained in the top contact carrier 190 have top contact tails 194, and the bottom contacts contained in the bottom contact carrier 191 have bottom contact tails 197. The contract tails 194, 197 may be solder tails or press-fit tails.

The inner shield 188 includes an extension 202 that extends beyond the distal end of the contact tails 194, 197. The inner shield extension 202 need not extend completely past the distal end of the contact tails 194, 197 and may extend along a portion of the contact tails 194, 197. The inner shield extension 202 provides isolation of the contact tails 194, 197 to reduce crosstalk therebetween. Reducing crosstalk allows the outlet to carry signals at higher transmission rates. The inner shield extension 202 is positioned between two rows of the contact tails 194, 197 in which the first row corresponds to the four top contact tails 194, and the second row corresponds to the four bottom contact tails 197.

Figure 3B:
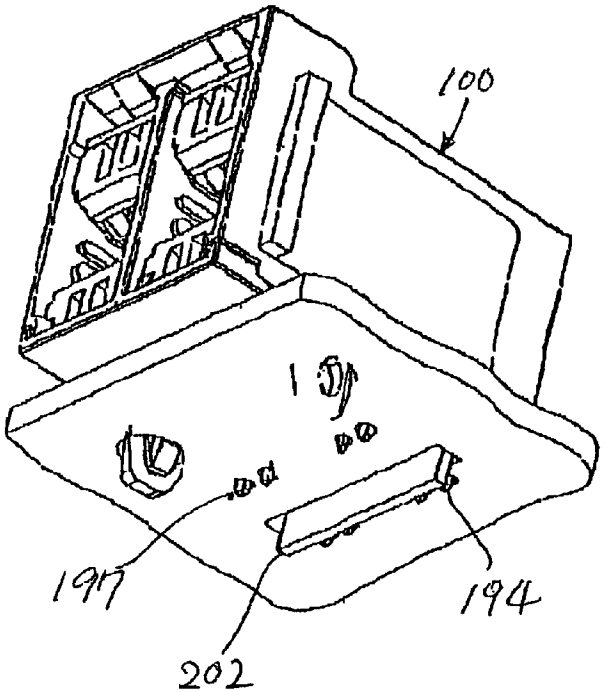
FIGS. 3A and 3B are perspective views of the outlet mounted on a printed circuit board according to a preferred embodiment of the present invention.
Figure 3A:
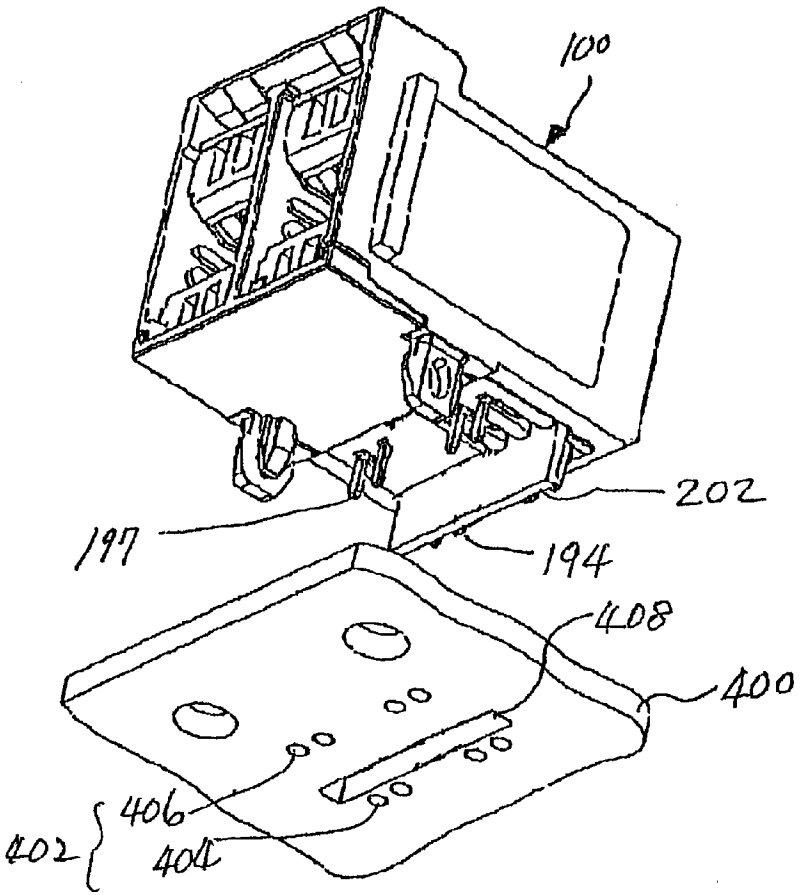

FIG. 3A is a perspective view of the outlet 100 and a simplified printed circuit board (PCB) according to the present invention. The PCB 400 includes a number of holes 402 for receiving the contact tails 194, 197. The holes 402 include a first row of holes 404 and a second row of holes 406 for receiving the top contact tails 194 and the bottom contact tails 197, respectively. The holes 402 in the PCB 400 may be plated with metal to provide electrical contact between the metal plated holes 402 and the corresponding contact tails 194, 197. The PCB 400 also includes a slot 408 for receiving the inner shield extension 202. The inside surface of the slot 408 may be plated with metal and the plating connected to a ground path on the PCB 400. Electrical contact between the plated slot 408 and the inner shield extension 202 may be made through frictional interference or other techniques such as soldering.

Figure 4B:
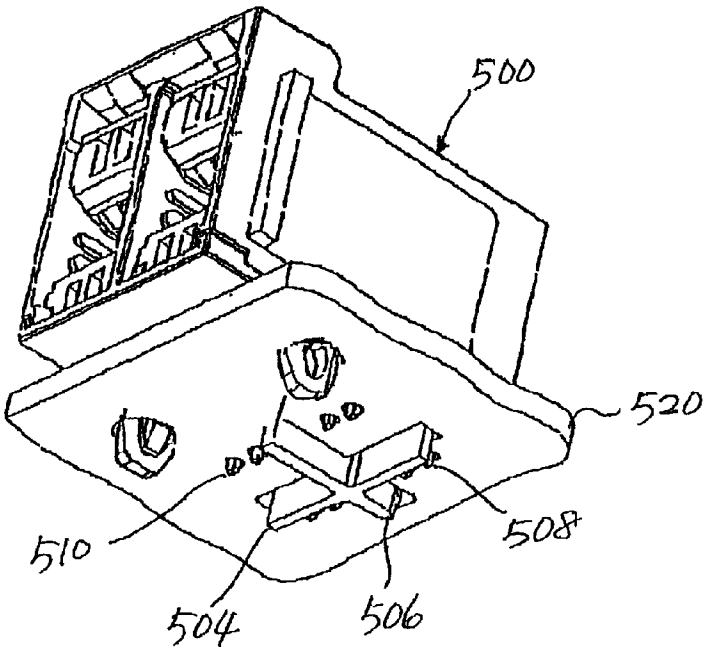
FIGS. 4A and 4B are perspective views of a telecommunication outlet mounted on a printed circuit board according to another preferred embodiment of the present invention.

FIG. 3B is a perspective view of the outlet 100 mounted on the PCB 400 according to the present invention. To mount the outlet 100 on the PCB 400, the contact tails and the inner shield extension are aligned with the holes and the slot, respectively, and then each is inserted into the respective opening. Before mounting the outlet 100 on the PCB 400, an insulating film (not shown) is preferably rested between the PCB 400 and the bottom of the outlet 100 to prevent an electrical short. As shown in FIG. 4B, the inner shield extension 202 is disposed as a shield between a row of top contact tails and a row of bottom contact tails protruding downwards from the PCB. Thus, the inner shield extension 202 prevents crosstalk from occurring between the top contact tails and the bottom contact tails. The outlet 100 of which contact tails are shielded outside the PCB, may be used in applications where high transmission rates are needed and may provide for transmission of signals (e.g., voice and data) at high data rates.

Figure 4A:
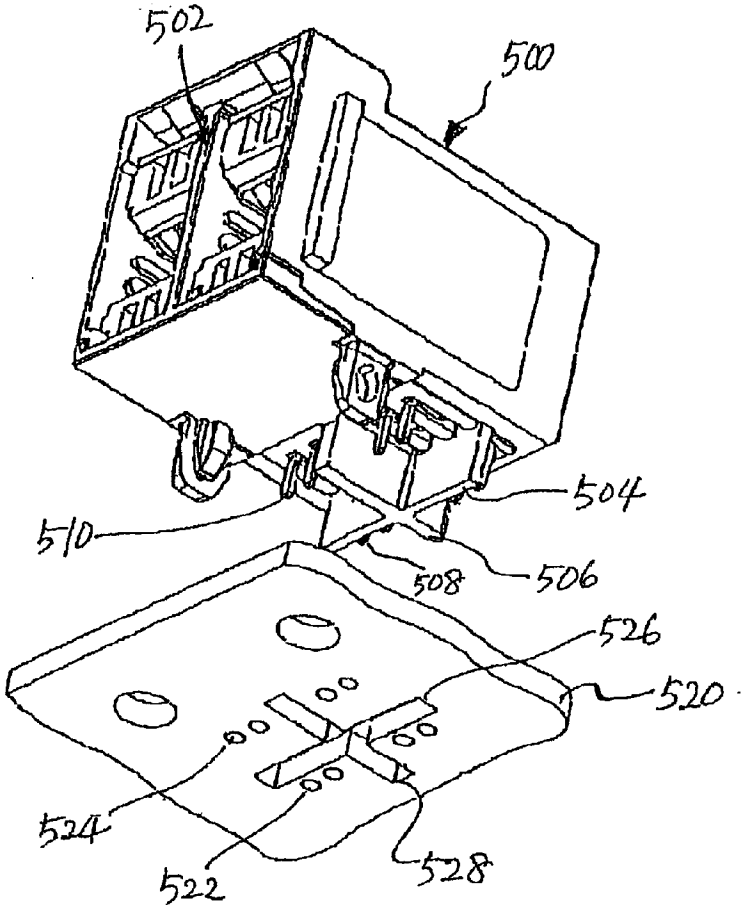

FIGS. 4A and 4B are perspective views of an outlet and a simplified PCB according to another embodiment of the present invention. Referring to FIG. 4A, the outlet 500 has a structure similar to that of the outlet 100 in FIGS. 1–3B, except for an inner shield and a vertical shield 502 having an inner shield extension 504 and a vertical shield extension 506. The inner shield and the inner shield extension 504 of the outlet 500 have the substantially same structure as the inner shield 188 and the inner shield extension 202 of the outlet 100 in FIGS. 1–3B. The vertical shield extension 506 extends downwards from the vertical shield 502 which is substantially same as the vertical shield 182 shown in FIGS. 1–2.

The inner shield extension 504 and the vertical shield extension 506 form a cross structure defining four quadrants each for shielding contact tails of a tip and ring pair. The inner shield extension 504 is disposed as a shield between a row of top contact tails 508 and a row of bottom contact tails 510. The vertical shield extension 506 is disposed as a shield between first and second columns of the contact tails which are arranged in rows and columns. Thus, contact tails corresponding to a tip and ring pair are positioned in each quadrant. The cross structure of the inner shield extension 504 and the vertical shield extension 506 extends beyond the distal end of the contact tails 508, 510. The cross structure need not extend completely past the distal end of the contact tails 508, 510 and may extend along a portion of the contact tails 508, 510. The inner shield extension 504 and vertical shield extension 506 provide isolation of the contact tails 508, 510 to reduce crosstalk therebetween. Reducing crosstalk allows the outlet 500 to carry signals at higher transmission rates.

The PCB 520 includes a first row of holes 522 for receiving the top contact tails 508 and a second row of holes 524 for receiving the bottom contact tails 510. The inside surface of the holes 522, 524 may be plated with metal. The PCB 520 also includes a horizontal slot 526 and a vertical slot 528 for receiving the inner shield extension 504 and the vertical shield extension 506, respectively. The inside surface of the slots 526, 528 may be plated with metal and the plating connected to a ground path on the PCB 520. Electrical contact between the metal plated slots 526, 528 and the inner shield extension 504 and vertical shield extension 506 may be made through frictional interference or other techniques such as soldering.

FIG. 4B is a perspective view of the outlet 500 mounted on the PCB 520. To mount the outlet 500 on the PCB 520, the contact tails 508, 510 and the extensions 504, 506 are aligned with the holes 522, 524 and the slots 526, 528, respectively, and then each is inserted into the respective opening. Before mounting the outlet 500 on the PCB 520, an insulating film (not shown) is preferably rested between the PCB 520 and the bottom of the outlet 500 to prevent an electrical short. As shown in FIG. 4B, the contact tails protrude from the bottom of the PCB 520, and the protruding contact tails are shielded from each other by the extensions which also protrude from the bottom of the PCB 520. In other words, the protruding contact tails 508, 510 are shield from each other by the protruding cross structure of the extensions 504, 506. Thus, the cross structure of the inner and vertical shield extensions 504, 506 isolates the contact tails 508, 510 to reduce crosstalk between the tip and ring pairs. Reducing crosstalk allows the outlet 500 to carry signals at higher transmission rates.

It is noted that the embodiment shown in FIGS. 1–3B may be more amenable to certain manufacturing processes such as wave soldering. By using only the inner shield extension, wave soldering in a direction parallel to the inner shield extension is not impeded and the contract tails are evenly exposed to solder.

Having described preferred embodiments of the telecommunication outlet according to the present invention, modifications and variations can be readily made by those skilled in the art in light of the above teachings. It is therefore to be understood that, within the scope of the appended claims, the present invention can be practiced in a manner other than as specifically described herein.

What is claimed is:

1. A telecommunication outlet for mounting on a printed circuit board, comprising:

a conductive housing having a top, a bottom, side walls joining said top and bottom, an outer shield and an inner shield, said outer shield, said inner shield, said top, said bottom, and said side walls being in electrical contact;

a vertical shield extending between said top and bottom; and a horizontal shield positioned between said top and bottom and between said sidewalls, said horizontal shield and said vertical shield defining four quadrants, each of said four quadrants containing contacts corresponding to a tip and ring pair;

wherein said contacts each have a contact tail extending downwards beyond said printed circuit board; and said inner shield has an extension extending downwards beyond said printed circuit board, said extension being a planar member positioned within a longitudinal slot formed in said printed circuit board, said extension being disposed between a first set of four contact tails and a second set of said four contact tails.

2. The telecommunication outlet of claim 1, wherein said extension of said inner shield extends beyond the distal end of said contact tails.

3. The telecommunication outlet of claim 1, wherein said printed circuit board includes holes for receiving said respective contact tails, said holes being plated with metal to provide electrical contact between said holes and said corresponding contact tails.

4. The telecommunication outlet of claim 1, wherein said slot is plated with metal to provide electrical contact between said slot and said extension of said inner shield.

5. The telecommunication outlet of claim 1, wherein said extension of said inner shield has a portion protruding downwards from said printed circuit board and said contact tails each have a portion protruding downwards from said printed circuit board, the length of said protruding portion of said extension being substantially equal to the length of said protruding portion of said contact tails.

6. The telecommunication outlet of claim 1, wherein said vertical shield includes an extension extending downwards beyond said printed circuit board.

7. The telecommunication outlet of claim 6, wherein said contact tails are arranged in rows and columns, and said extension of said inner shield is disposed between two rows of said contact tails and said extension of said vertical shield is disposed between two columns of said contact tails.

8. The telecommunication outlet of claim 6, wherein said extension of said vertical shield extends beyond the distal end of said contact tails.

9. The telecommunication outlet of claim 6, wherein said printed circuit board includes a slot for receiving said extension of said vertical shield.

10. The telecommunication outlet of claim 9, wherein said slot is plated with metal to provide electrical contact between said slot and said extension of said vertical shield.

11. The telecommunication outlet of claim 6, wherein said extension of said vertical shield has a portion protruding downwards from said printed circuit board and said contact tails each have a portion protruding downwards from said printed circuit board, the length of said protruding portion of said extension of said vertical shield being substantially equal to the length of said protruding portion of said contact tails.

12. The telecommunication outlet of claim 6, wherein said extension of said vertical shield is integral with said extension of said inner shield.

13. The telecommunication outlet of claim 6, wherein said extension of said vertical shield and said extension of said inner shield form a cross structure extending downwards beyond said printed circuit board.

14. The telecommunication outlet of claim 13, wherein said cross structure defines four quadrants each for shielding said contact tails of a tip and ring pair.

15. The telecommunication outlet of claim 14, wherein said printed circuit board includes a cross slot for receiving said cross structure of said extensions of said vertical and inner shields.

* * * * *